United States Patent [19]

Meier

[11] 3,931,913

[45] Jan. 13, 1976

[54] SLIDE GATE NOZZLE

[75] Inventor: Ernst Meier, Adliswil, Zurich, Switzerland

[73] Assignee: Stopinc Aktiengesellschaft, Zug, Switzerland

[22] Filed: Nov. 18, 1974

[21] Appl. No.: 524,944

[30] Foreign Application Priority Data

Nov. 16, 1973 United Kingdom ..... 53356/73

[52] U.S. Cl. ..... 222/146 C; 222/541; 222/561; 266/38; 266/42

[51] Int. Cl.[2] ..... B22D 37/00; B22D 41/08

[58] Field of Search ..... 222/1, 146 C, 541, 561, 222/DIG. 1; 164/281; 266/38, 42

[56] References Cited

UNITED STATES PATENTS

| | | | |
|---|---|---|---|
| 1,833,739 | 11/1931 | Davis | 266/42 |
| 3,743,139 | 7/1973 | Lyman | 266/38 X |
| 3,794,218 | 2/1974 | Yanagida et al. | 266/38 X |

FOREIGN PATENTS OR APPLICATIONS

| | | | |
|---|---|---|---|
| 452,123 | 5/1968 | Switzerland | 222/561 |

*Primary Examiner*—Robert B. Reeves
*Assistant Examiner*—David A. Scherbel
*Attorney, Agent, or Firm*—Wenderoth, Lind & Ponack

[57] ABSTRACT

A slide gate nozzle for the spout of metallurgical vessels includes a pair of plates, arranged on the opening of a pouring channel. The plates include a fixed bottom plate and a displaceable sliding plate. A metal part is provided in the pouring channel of the spout of the vessel. This part closes the cross section of the channel and is constructed in such a manner as to be cooled and/or give off heat on the side thereof which is turned away from the interior of the vessel.

7 Claims, 2 Drawing Figures

SLIDE GATE NOZZLE

BACKGROUND OF THE INVENTION

The invention relates to improvements in the operation of slide gate nozzles in their application to metallurgical vessels in particular to ladles and the like for liquid steel.

When such ladles are refilled with liquid steel their walls are inevitably at a considerably lower temperature than the melting point of steel. This is particularly the case in the narrow exit channel leading from the bottom of the ladle to the closed sliding plate of the slide gate nozzle. For design reasons this channel can neither be shortened nor widened at will. In consequence the liquid steel pouring into this channel inevitably freezes, so that the slide gate becomes inoperative, i.e. does not allow steel to pass through in the open position.

The universal remedy for this drawback is the introduction of oxygen into this channel which ignites the large lump of frozen but still very hot steel so that the exothermic reaction thaws the blocked passage. Though effective, this method is very undesirable and not without danger.

Other methods have been proposed but none without other drawbacks and/or with lasting success. Among them is the filling of the exit channel with refractory material of a suitable grain size prior to refilling the ladle itself. This prevents the steel from entering the channel prior to teeming. Even when the method works satisfactorily it has the drawback of allowing this refractory material to drain into the mold which is in many cases highly undesirable.

SUMMARY OF THE INVENTION

It is the object of the invention to overcome or minimize these difficulties and drawbacks.

According to the invention this is achieved by providing in the exit channel, near the bottom of the vessel, a cooled metal member which extends across the channel and substantially and preferably completely blocks it to the downward passage of the liquid metal. The cooling is achieved by allowing sufficient heat to radiate downwards from the member, and/or by providing the top of the metal member (which otherwise would be in contact with the liquid metal) with a thin layer of insulating material, and/or by allowing a stream of inert gas, preferably argon, to pass through interstices or perforations in the member into the liquid steel above it. Preferably, the metal member should have the shape of an inverted thin-walled cup and in the case of a ladle for liquid steel should be made of a metal having a melting point at least as high as steel, preferably steel itself.

The metal member is inserted into the channel when the ladle is empty, so that in the process of filling the ladle the liquid metal cannot enter into the channel. If one or more of above mentioned methods of keeping the member cool are adopted the member will become very hot but will not melt, i.e. it will remain effective until it is desired to teem. At this moment a very slight change in the heat transfer equilibrium which keeps the member from melting will suffice to melt it down, thus opening the channel to the passage of steel. This change can be effected in a number of ways. One method is to allow a small stream of oxygen to come in contact with the member. Another is to shut off the cooling stream of inert gas.

In certain cases it is also possible to apply a mechanical method, i.e. to increase the inert gas pressure under the member to such an extent that it is blown up into the ladle.

BRIEF DESCRIPTION OF THE DRAWINGS

In order that the invention may be better understood reference will now be made to the accompanying drawing in which.

DETAILED DESCRIPTION OF THE INVENTION

Figure 1:
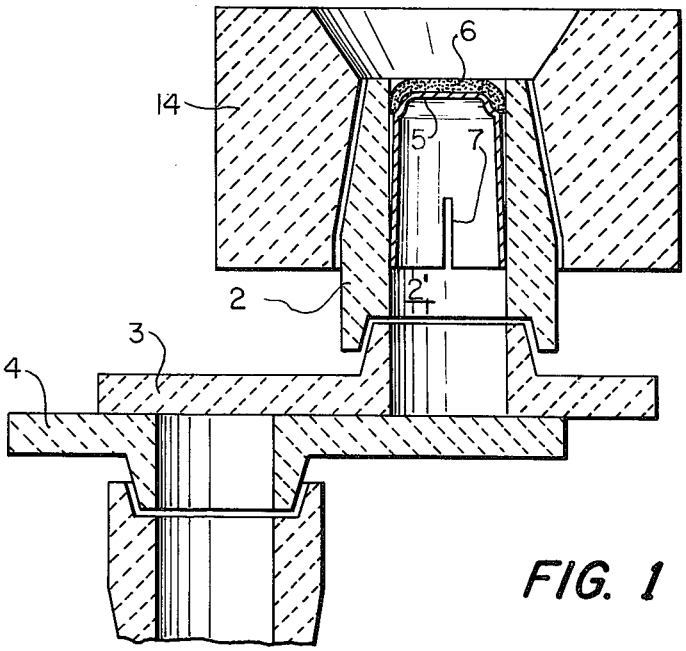
FIG. 1 is a cross-sectional view of a first embodiment of the invention.
Figure 2:
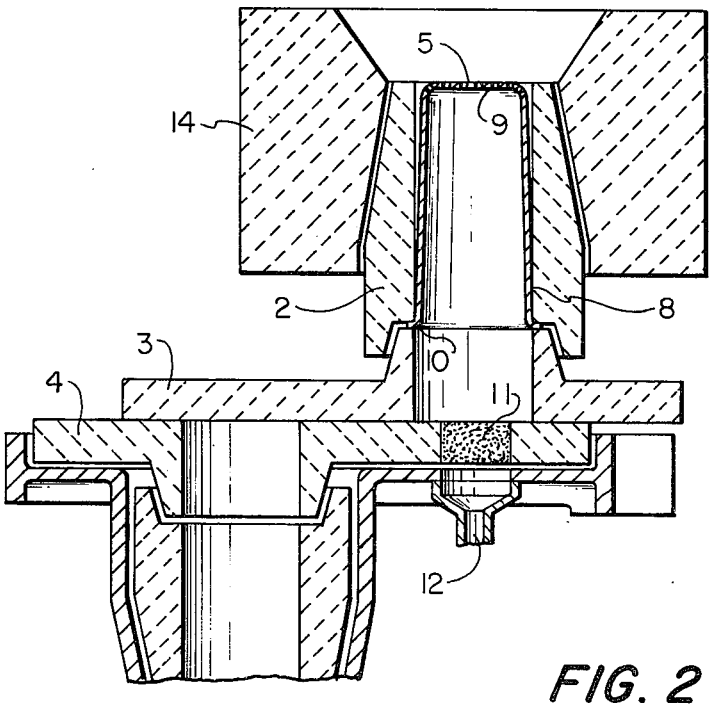
FIG. 2 is a cross-sectional view of a second embodiment of the invention.

FIGS. 1 and 2, show, by way of example, part of a typical sliding gate nozzle with the annular brick 1 at the bottom of a ladle. The ring bush 2 forming the teeming channel 2' is inserted into the annular brick 1. The sliding gate comprises the fixed plate 3 and sliding plate 4 which is shown in the closed position.

The arrangement according to FIG. 1 shows an inverted thin-walled steel cup 5 protected by the insulating layer 6 which may consist of a sheet of asbestos or refractory felt like Kao-wool or Cerafelt. The cup has a longitudinal cut 7 which permits it to be held in position by a forced fit.

The arrangement according to FIG. 2 shows an inverted cup 8 which has a suitable number of perforations 9 and is held in position within the bush 2 by the flange 10. The sliding plate 4 is provided with a gas permeable porous refractory brick 11 firmly fixed in place and registering with the bush 2 in the closed position of the sliding plate. The porous brick communicates with a supply of inert gas 12, preferably argon. When the ladle is still empty a strong stream of inert gas is blown into the channel of the ring bush 2 and escapes into the ladle through the perforations 9, thus cooling the top of the cup 8 prior to filling the ladle. When the ladle is filled the pressure of the inert gas is kept well above the static head of the metal at the bottom of the ladle, so that the inert gas continues to stream through the perforations, thus preventing the cup from melting. As soon as teeming is to commence the sliding plate is pushed into the open position, thus automatically shutting off the stream of inert gas. The cup collapses and the metal can be teemed.

It will be appreciated that the two arrangements may be combined if desired.

In all cases the desired object is achieved by almost or even completely eliminating the use of materials which would adulterate the liquid steel by being swept with steel stream into the mold or vessel. The method is also quite safe and inexpensive.

The illustration shows the most common type of sliding gate in which the closing movement is linear. It will be appreciated that the invention can equally well be applied for any other types of movement, e.g. rotary, or other geometrical shapes of the contact surfaces, e.g. conical instead of plane.

What is claimed is:

1. A slide gate nozzle for the spout of a metallurgical vessel said slide gate nozzle comprising:

a pair of plates arranged on the opening of a pouring channel of said spout, said pair of plates including a fixed bottom plate and a displaceable sliding plate; and a metal element positioned in said pouring channel of said spout, said element closing the cross section of said channel, said metal element, on the side thereof turned toward the interior of said vessel, being provided with an insulating layer of refractory material, the other side of said metal element being free for radiation of heat.

2. A slide gate nozzle as claimed in claim 1, wherein said metal element has the shape of an inverted thin walled cup having a bottom turned toward the interior of the vessel and a wall with a flange forming a seat in cooperation with the wall of said pouring channel.

3. A slide gate nozzle as in claim 2, wherein said cup-shaped metal element has in the wall thereof a longitudinal cut.

4. A slide gate nozzle as claimed in claim 1, wherein said metal element is formed of steel.

5. A slide gate nozzle for the spout of a metallurgical vessel said slide gate nozzle comprising:

a pair of plates arranged on the opening of a pouring channel of said spout, said pair of plates including a fixed bottom plate and a displaceable sliding plate;

a metal element positioned in said pouring channel of said spout, said element closing the cross section of said channel, said metal element being provided with perforations for the purpose of introducing gas into the interior of said vessel; and said sliding plate having therein a gas permeable refractory brick connected to a gas connection, said refractory brick being positioned below said pouring channel in the closed position of the slide.

6. A slide gate nozzle as claimed in claim 5, wherein said metal element has the shape of an inverted thin walled cup having a bottom turned toward the interior of the vessel and a wall with a flange positioned between said fixed bottom plate and said spout.

7. A slide gate nozzle as claimed in claim 5, wherein said metal element is formed of steel.

* * * * *